US008061106B2

(12) United States Patent
Clark

(10) Patent No.: US 8,061,106 B2
(45) Date of Patent: Nov. 22, 2011

(54) PERGOLA STRUCTURE

(75) Inventor: Gordon Clark, Dover, NH (US)

(73) Assignee: Vinyl Fences, Inc., Dover, NH (US)

( * ) Notice: Subject to any disclaimer, the term of this patent is extended or adjusted under 35 U.S.C. 154(b) by 48 days.

(21) Appl. No.: 12/814,067

(22) Filed: Jun. 11, 2010

(65) Prior Publication Data

US 2011/0197536 A1 Aug. 18, 2011

Related U.S. Application Data

(60) Provisional application No. 61/304,911, filed on Feb. 16, 2010.

(51) Int. Cl.
*E04H 12/00* (2006.01)

(52) U.S. Cl. ..... 52/650.3; 52/650.1; 52/653.1

(58) Field of Classification Search ..... 52/169.9, 52/296, 299, 653.1, 650.3, 90.1, 92.1, 93.1, 52/93.2, 263, 298, 648.1; 135/121, 156, 135/120.3

See application file for complete search history.

(56) References Cited

U.S. PATENT DOCUMENTS

| | | | | |
|---|---|---|---|---|
| 4,229,919 | A * | 10/1980 | Hughes | 52/263 |
| 7,900,417 | B1 * | 3/2011 | Leines | 52/650.3 |
| 2005/0081460 | A1 * | 4/2005 | Davis | 52/169.9 |
| 2005/0257464 | A1 * | 11/2005 | Skulsky | 52/311.1 |

* cited by examiner

*Primary Examiner* — Brian Glessner
*Assistant Examiner* — Brian D Mattei
(74) *Attorney, Agent, or Firm* — Davis & Bujold, P.L.L.C.

(57) ABSTRACT

A system of structural elements for a pergola structure including vertical posts supporting a roof formed of carrying rails supported by the posts and cross rails supported by the carrying rails. Each post includes a post core element, a post shell enclosing the post core element, and a post shell adapter. Each carrying rail adapter mounts a carrying rail to a post and includes a post core interior adapter joined with a single or dual carrying rail retainer, and each rail connector mounts a cross rail to a carrying rail. The elements may further include shell extensions and beam filled rails comprising a rail shell and a reinforcing beam insert.

15 Claims, 8 Drawing Sheets

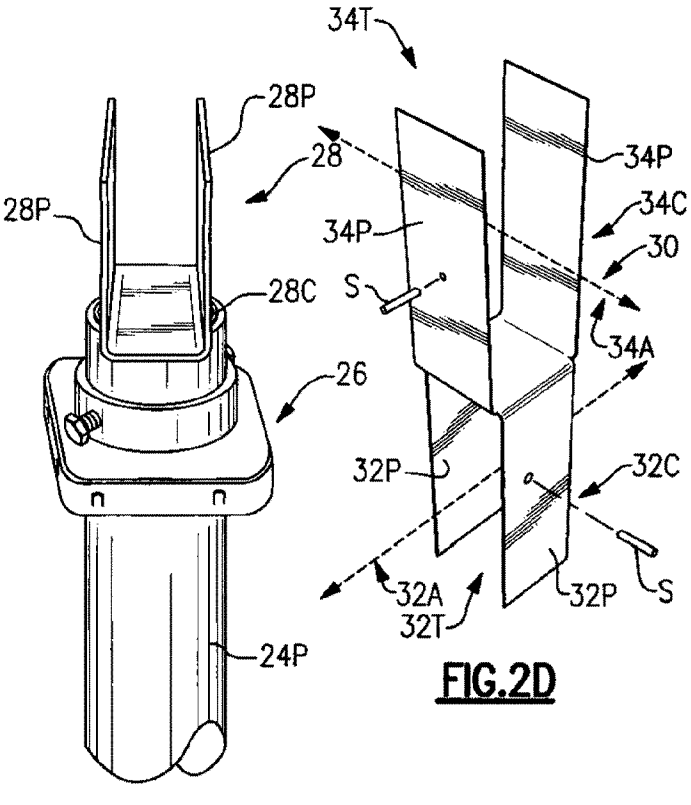
FIG.2D
FIG.2C
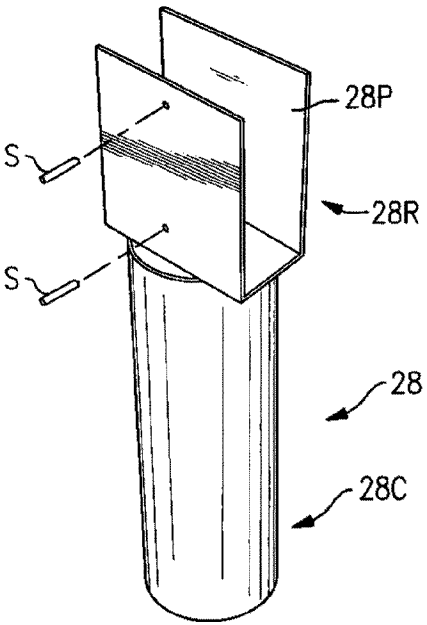
FIG.2B
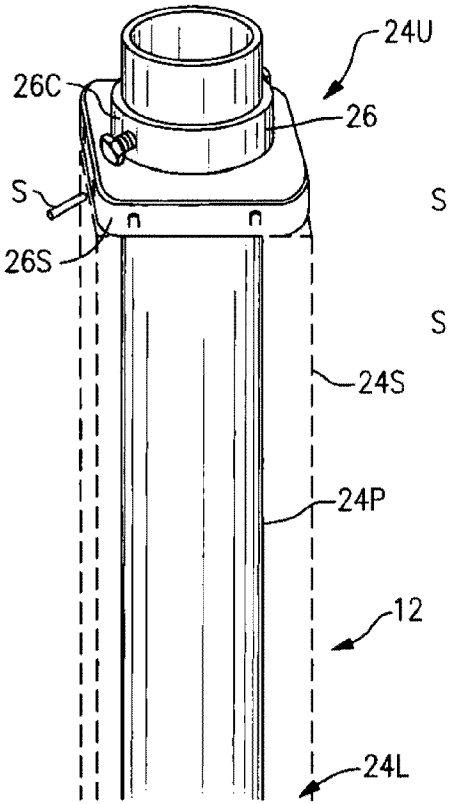
FIG.2A

PERGOLA STRUCTURE

FIELD OF THE INVENTION

The present invention relates to a structural assembly for and a method for assembly of a pergola type structure.

BACKGROUND OF THE INVENTION

A pergola is a type of structure originally employed in gardens and similar environments to support, for example, woody vines, or to provide a horizontal open-work roof-like structure over outdoor areas, such as patios, terraces and walkways. Pergola structures continue to be used to shelter patios, terraces and walkways and for landscaping purposes, as decorative structures or for screening unwanted view, and are often for utilitarian purposes, such as sheltering storage areas and parking areas for vehicles.

A classic pergola type structure includes a plurality of upright posts typically arranged around the periphery of a rectangular area and covered by a roof formed of a rectangular grid or lattice comprised of a first layer of carrying rails or beams supported by the upright posts and an upper layer of cross rails or beams supported by and orthogonal to the carrying rails. A pergola structure may, however, assume plans other than the rectangular or square form, such as two or more mating rectangles or squares or a multi-angular plan, with appropriate adaptations in the details of the post and rail assemblies. In addition, one or more sides or ends of a pergola structure may be comprised of another structure, such as the side of a house or a wall.

Both classical and contemporary pergola structures, however, present a number of problems. For example, although pergola structures are comprised of a limited number of types or different forms of elements, that is, upright posts, carrying rails and cross rails with a few decorative trim elements, a given pergola structure is comprised of a relatively large number of such elements, resulting in a complex and time consuming assembly that typically must be constructed by an experienced worker in order to obtain a relatively strong structure.

In addition, the inherent design of pergola structures is such that the elements are not mated or assembled to one another in a manner to result in an inherently strong structure. That is, and for example, the upright posts are rarely provided with any form of bracing, except by the carrying rails at their top, the cross rails are only weakly secured to the carrying rails and contribute little to the to the strength of the structure, and a pergola structure contains many joints, all of which are exposed to the weather and stress and thereby comprise points of weakness. These problems are compounded by the materials used to construct pergolas, which are classically constructed of wood, which is highly susceptible to weather and rot, particularly at the joints.

Contemporary pergola structures, including those intended for construction by relatively unskilled persons, have attempted to address at least some of these problems. For example, contemporary pergola structures typically employ man made materials, such as metal, fiberglass or various forms of plastic elements, often as shells encasing metal, fiberglass or polyvinyl chloride (PVC) structural elements assembled by, for example, nuts and bolts, screws or glues, and often in kit form for assembly by home handicraftsmen. Such structures, however, while avoiding or alleviating at least certain of the effects of weather and exposure to the elements, typically have many of the problems presented by traditional materials and constructions methods, that is, assembly of painted wood parts. That is, it is often difficult for relatively unskilled workers to assemble a satisfactory structure, and the materials used, in composition, dimensions and design, and the design of the structural elements and their assembly, often do not result in a satisfactory structure, even when assembled correctly, with the jointing of the component parts remaining a particular problem.

The present invention provides a solution to these and related problems of the prior art.

SUMMARY OF THE INVENTION

The present invention is directed to a system of structural elements for construction of a pergola-type structure including a plurality of vertical posts arranged around the periphery of an area and covered by a roof formed of a first layer formed of a plurality of carrying rails supported by the posts and an upper layer formed of a plurality of cross rails supported by and orthogonal to the carrying rails wherein the structural elements include at least four posts, carrying rail adapters and rail connectors.

Each post includes a post core element, a post shell enclosing the post core element, and at least two post shell adapters for mounting the post shell to the post core element. According to the invention, a post adapter includes a post core exterior adapter joined with a post shell adapter wherein an interior shape and dimensions of the post core exterior adapter closely accepts an exterior shape and dimensions of the post core element and the outer shape and dimensions of the post shell adapter fit closely within the shell and a post adapter securing element to mount the post adapter to the post core element. The post adapter may further include a shell adapter plate comprised of a generally flat plates having a central opening sized and shaped to closely accept and fit onto the exterior shape and dimensions of the post core exterior adapter and an outer shape and dimensions to closely fit within and accept an interior shape and dimensions of one of a post shell and a shell trim element.

Each carrying rail adapter mounts a carrying rail to a post and includes a post core interior adapter joined with a U-shaped carrying rail retainer wherein the post core interior adapter is adapted to fit closely within an interior of an upper end of a post core element. The carrying rail retainer may comprise a single carrying rail retainer that includes two upwardly extending carrying rail retaining plates spaced apart along an axis perpendicular to an axis of a carrying rail by a distance to closely receive a carrying rail. Alternately, the carrying rail retainer may comprise a dual carrying rail retainer having one of a square and a rectangular horizontal cross section and extending upwards from a top of the core adapter by a distance generally corresponding to a height of a carrying rails horizontal dimensions forming ledges for receiving and supporting a carrying rail on each side of the dual carrying rail retainer.

Each rail connector in turn mounts a cross rail to a carrying rail and each rail connector may comprise one of a downwardly extending U-shaped carrying rail connector and an upwardly extending U-shaped cross rail connector with an axis of the carrying rail connector and an axis of the cross rail connector being oriented at a right angle so that the cross rail is mounted to a rail connector at a right angle to the carrying rail. In an alternate embodiment, an L-shaped angle bracket is affixed between a carrying rail and a cross rail, or a U-shaped angle bracket is affixed between a carrying rail and a cross rail.

The system of structural elements may further include a shell extension for enclosing a rail adapter and a rail connector of a corner post wherein each shell extension is a hollow structure of four vertical walls, open at an upper end and a lower end, and of a height and width to enclose the rail adapter and rail connector and having upper and lower pairs of rail openings for respectively receiving a cross rail and a carrying rail, the upper pair of rail opening being oriented at a right angle to the lower pair of rail openings.

The system of structural elements may also include beam filled rails wherein each beam filled rail includes a rail shell and an beam insert wherein the rail shell has a generally rectangular cross section with outside dimensions corresponding to a carrying rail or a cross rail and inside dimensions for closely accepting the beam insert. A beam insert, in turn, has a generally rectangular cross section of dimensions to fit closely within the rail shell and includes two vertically oriented, hollow generally rectangular sections, each of which is defined by a vertical outer wall extending a height of the beam insert and two horizontal end walls extending from an upper edge and a lower edge of the corresponding outer wall for approximately half a width of the beam insert and wherein the beam insert sections are joined across a vertical extent of the beam insert sections by a shared vertically oriented web connecting the inner edges of the upper and lower end walls.

Further aspects of the present invention include decorative environmental sealing caps for the upper ends of the shell extensions and decorative environmental sealing end caps for the carrying and cross rails.

BRIEF DESCRIPTION OF THE DRAWINGS

The invention will now be described, by way of example, with reference to the accompanying drawings in which:

FIG. 2A is an isometric illustration of a post adapter;

FIGS. 2B and 2C are isometric illustrations of a carrying rail adapter;

FIGS. 2D and 2E are isometric illustrations of a rail connector;

DETAILED DESCRIPTION OF THE INVENTION

Figure 1:
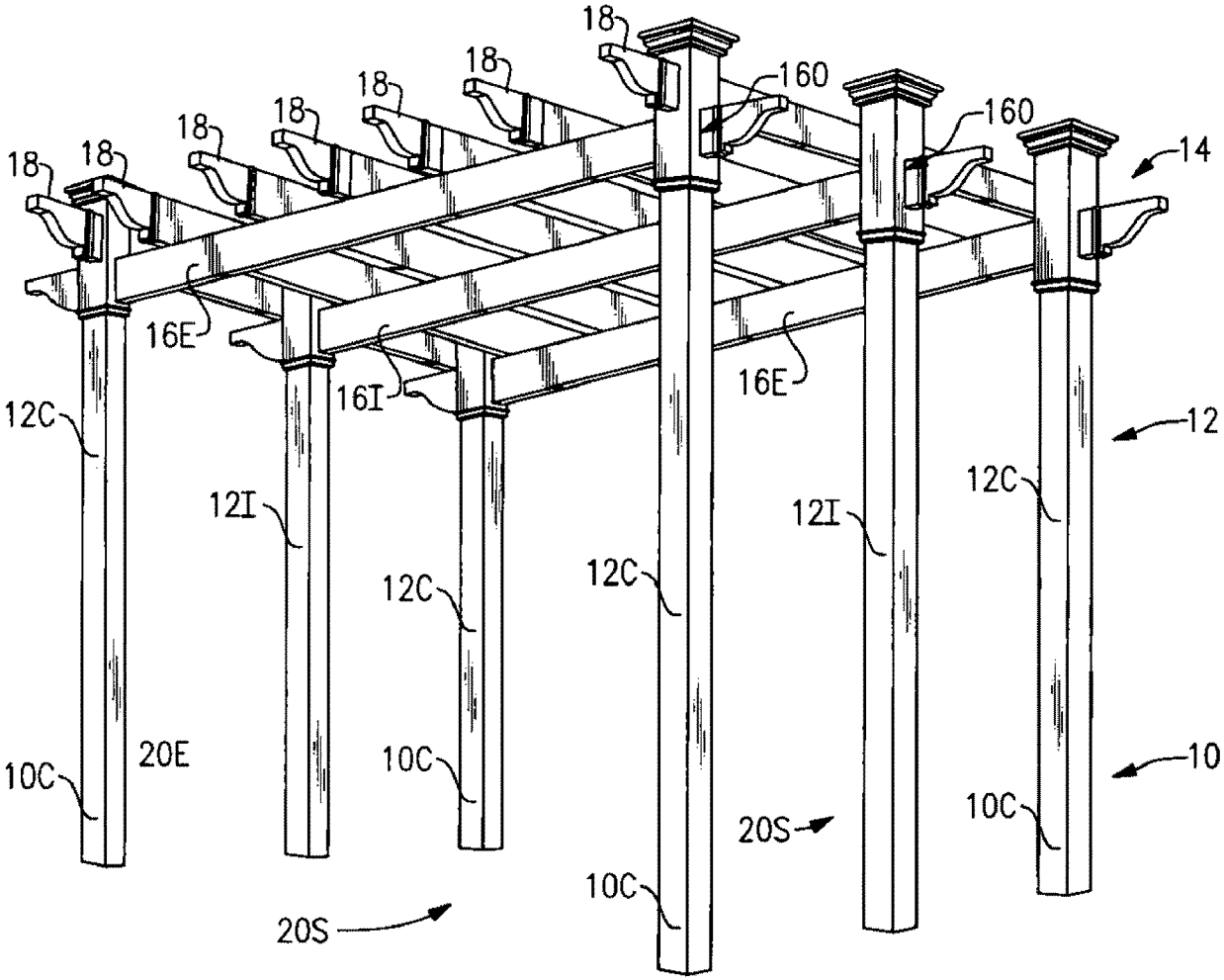
FIG. 1 is an isometric illustration of an exemplary pergola structure.

As described herein above and as illustrated in FIG. 1, a classic generally rectangular pergola type structure 10 includes a plurality of vertical posts 12 arranged around the periphery of an area that is covered by a roof 14 comprised of a rectangular grid or lattice of roof rails 16, 18 supported by the upright posts 12. For purposes of the following description and discussions, a pergola structure may be considered to have two ends 20E comprised of opposing sides of the rectangular area and two sides 20S comprised of the remaining opposing sides of the structure, which are orthogonal to the ends 20E of the structure 10.

It will be recognized, however, that a pergola structure 10 may assume configurations other than the simple rectangular or square form, such as two or more mating rectangles or squares, a walkway or a multi-angular plan, with appropriate adaptations in the details of the post and rail assemblies. In addition, one or more sides or ends of a pergola structure may be comprised of another structure, such as the side of a house or a wall.

Considering an exemplary rectangular pergola-type structure 10 as shown in FIG. 1, a pergola-type structure 10 will include at least four corner posts 12C, with one corner post 12C being located at each corner 10C of the area to be covered, and may include intermediate posts 12I along either or both of the ends 20E or sides 20S of the structure 10, with the intermediate posts 12I typically being located along the periphery of the area to be covered. The presence and number of intermediate posts 12I may be determined by, for example, the size of the structure and anticipated loads on the structure and thus the number of upright posts required to support the pergola structure, or by the desired visual effect, including the desired spacing of upright posts 12 and the dimensions of the roof 14. In a typical and exemplary pergola structure 10, for example, corner and intermediate posts 12C, 12I will typically be square and measure about 2 inches by 2 inches to about twelve inches by twelve inches, and more preferably measure about 4 inches by 4 inches to 8 inches by 8 inches and may extend between about 7 feet to about 20 feet from ground or foundation level, more preferably may extend between about 8 feet to about 15 feet, to the lower side of the roof 14, but may also, for example, be of rectangular or circular cross section, or a combination of cross sections, of generally comparable dimensions.

The roof 14 of a pergola type structure 10 will include, at a minimum, two horizontally disposed end carrying rails 16E respectively located at each of the first and second ends 20E of the structure 10 and extending along the first and second ends 20E of the structure 10 between first and second sides 20S of the structure 10. The end carrying rails 16E will be supported by the corner posts 12C of the structure and, in the classical pergola structure 10, the end carrying rails 16E pass through, or will appear to pass through, corresponding openings 16O in the upper ends 12U of the upright posts 12.

If the structure 10 includes additional intermediate posts 12I located along the first and seconds ends 20E of the structure 10, the structure 10 may include additional horizontally disposed intermediate carrying rails 16I wherein the intermediate carrying rails will be located between and parallel to the two end carrying rails and will extend between the sides of the structure. The intermediate carrying rails 16I will be supported by corresponding pairs of intermediate posts 12I located along the ends 20E of the structure 10 and the intermediate carrying rails 16I will again, in the classic structure, pass through, or will appear to pass through, corresponding openings 16O in the upper ends 12U of the intermediate posts 12.

In a typical and exemplary pergola structure 10, for example, end and intermediate carrying rails 16E, 16I are placed with their width vertical, that is, with their second greatest dimension extending perpendicular to the ground, and may have a height in the range of about 6 inches to about 12 inches or so, a thickness in the range of about 1½ inches to about 4 inches or so and a length in the range of about 4 feet to about 24 feet or so.

The roof 14 of a pergola structure 10 further includes an upper layer comprised of a plurality of parallel cross rails 18 supported on and at right angles to the end and intermediate carrying rails 16E and 16I and that complete the "grid" or "lattice" roof 14 of the structure by extending and between the first and second ends 20E of the structure. In a typical and exemplary pergola structure 10, for example, cross rails 18, like the carrying rails 16, are placed with their width oriented vertically, that is, with their second greatest dimension extending perpendicular to the ground, and may have a height in the range of about 6 inches to about 12 inches or so, a thickness in the range of about 1½ inches to about 4 inches or so and a length in the range of about 4 feet to about 24 feet or so.

Referring now to FIGS. 2A, 2B and 2C, therein are respectively shown elements of the present invention for assembling the components parts of a pergola structure 10.

As illustrated in FIG. 2A, a post 12 of a structure 10 of the present invention is comprised of a post core element 24P and a post shell 24S, shown in dashed outline form, that is secured to and supported by the post core element 24P by post adapters 26. In presently preferred embodiments, a post core element 24P may be comprised, for example, of a pipe of appropriate diameter to provide the desired strength, such as, for example, a 3 or 4 inch diameter galvanized pipe, but may alternately be comprised of, for example, an aluminum, fiberglass or polyvinyl chloride (PVC) pipe of similar dimensions, or of other materials. The length of post core element 24P is generally sufficient that a lower end 24L extends into the ground or a foundation by an amount sufficient to maintain the post 12 in the vertical position with upper end 24U being located at approximately the lower sides or edges of carrying rails 16.

As illustrated, a post adapter 26 is comprised of post core exterior adapter 26C joined with a post shell adapter 26S by, for example, being formed with the post shell adapter 26S or assembled to the post shell adapter 26S, or the reverse. The interior shape and dimensions of post core exterior adapter 26C are such as to closely accept and fit to the exterior shape and dimensions of the post core element 24P. For example, and as illustrated, the post core exterior adapter 26C may be in the form of a hollow cylinder of a diameter to closely accept the outer diameter of post core element 24P and of sufficient length to permit the post core exterior adapter 26C to be secured to the post core element 24P by a securing element S, such one or more bolts extending through openings or holes in the post core exterior adapter 26C and the wall of the post core element 24P or, in alternate implementations, by metal screws or adhesives.

The outer shape and dimensions of post shell adapter 26S, in turn, are such as to fit closely within the post shell 24S. As illustrated, a post 12 assembly typically includes a first post adapter 26 at the top end 24U of the post core element 24P, and a second post adapter 26 at the lower end of the post shell 24S, which would typically be at or just above the ground or foundation level of the post 12, although the lower end of the post shell 24S may be secured with respect to the post core element 24P in other ways, such as by being embedded in a foundation. The shape of post shell adapter 24S is generally thereby adequate to secure the post shell 24S to the post adapter 26 without further elements, such as bolts, screws or adhesives, but such may be employed if desired or necessary.

FIGS. 2B and 2C are diagrammatic isometric illustrations of a carrying rail adapter 28 by which a carrying rail 16 is secured to the upper end 12U of a post 12 and, for this purpose, includes a carrying rail retainer 28R joined with a post core interior adapter 28C by, for example, being formed with or assembled with the post core interior adapter 28C, or the reverse. The exterior shape and dimensions of post core interior adapter 28C are such as to fit closely within the interior of upper end 24U of post core element 24P, and is of such a length as to provide a secure junction between the post core interior adapter 28C and the post core element 24P. In the illustrated embodiment, for example, post core interior adapter 28C is cylindrical, of an outer diameter to fit closely within the interior of the post core element 24P and, for a 3 inch diameter post core element 24P, may have a length on the order of approximately 8 to 12 inches. Again, post core interior adapter 28C may be secured to post core element 24P by, for example, one or more bolts extending through openings or holes in the wall of post core interior adapter 28C and the wall of the post core element 24P or, in alternate implementations and for example, by metal screws or adhesives.

Carrying rail retainer 28R is located on the upper end of post core interior adapter 28C and is a generally U-shaped element that includes two upwardly extending carrying rail retaining plates 28P which are spaced apart along an axis perpendicular to the axis of the carrying rail 16 and by a distance to closely receive a carrying rail 16 with the greater width of the carrying rail 16 being oriented vertically, as described above. As shown, the height of carrying rail retaining plate 28P is approximately equal to or slightly less than the width of a carrying rail 16 and the width of each carrying rail retaining plate 28P is approximately equal to the exterior diameter of the post core element 24P.

A carrying rail 16 is typically secured into the carrying rail retainer 28R of a carrying rail adapter 28 by a securing element S, such as one or more bolts extending through corresponding openings or holes in the carrying rail retaining plates 28P and carrying rail 16 or, in alternate implementations and for example, by screws, nails or adhesives.

Figure 2E:
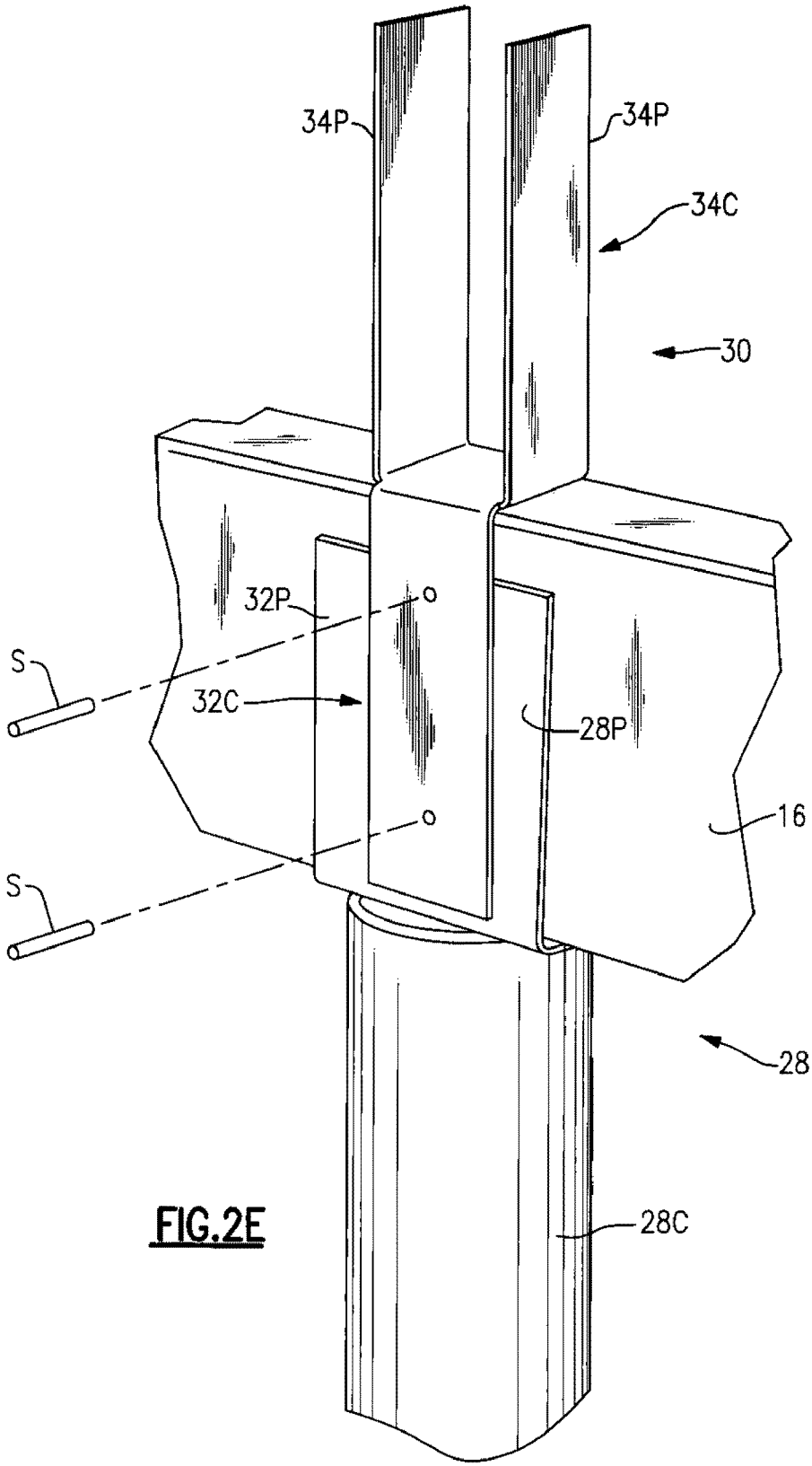

Lastly, cross rails 18 are in turn secured to carrying rails 16 by rail connectors 30, as illustrated in FIGS. 2D and 2E, wherein each rail connector 30 includes a downwardly extending U-shaped carrying rail connector 32C joined with an upwardly extending U-shaped cross rail connector 34C by, for example, being formed with or assembled with the cross rail connector 34C, or the reverse. Carrying rail connector 32C includes two downwardly extending carrying rail retaining plates 32P forming a trough 32T with an axis 32A for closely fitting over a carrying rail 16 while cross rail connector 34C includes two upwardly extending cross rail retaining plates 34P forming a trough 34T with an axis 34A for closely receiving a cross rail 18. As shown, the axis 32A of carrying rail connector 32C is oriented at a right angle to the axis 34A of cross rail connector 34C, thereby orienting the cross rail 18 at a right angle to the carrying rail 16.

A rail connector 30 may be secured to a carrying rail 16 by means of, for example, securing elements S, such as one or more bolts extending through corresponding openings or holes in the carrying rail retaining plates 32P and the carrying rail 16, or by screws, nails or adhesives. In a like manner, a cross rail 18 may be secured to a rail connector 30 by, for example, securing elements S, such as one or more bolts extending through corresponding openings or holes in the cross rail retaining plates 34P and cross rail 18, or, for example, by screws, nails or adhesives, so that the cross rails 18 are thereby secured to the carrying rails 16 at right angles to the carrying rails 16.

It will be noted that, as illustrated in FIG. 2E, at each corner post 12C and intermediate post 12I the upwardly extending carrying rail retainer plates 28P of the carrying rail adapter 28 will overlap the downwardly extending carrying rail retaining plates 32P of the corresponding rail connector 30. As a result, the elements, such as bolts or screws, for example, securing the carrying rail 16 to the carrying rail retaining plates 28P of the carrying rail adapter 28 will also secure the carrying rail retaining plates 32P of the rail connector 30 and thereby the cross rail 18 to the carrying rail 16, the post core interior adapter 28C and the post core element 24P, thereby providing a strong interconnection of the corner structural elements of the pergola structure 10.

Figure 3:
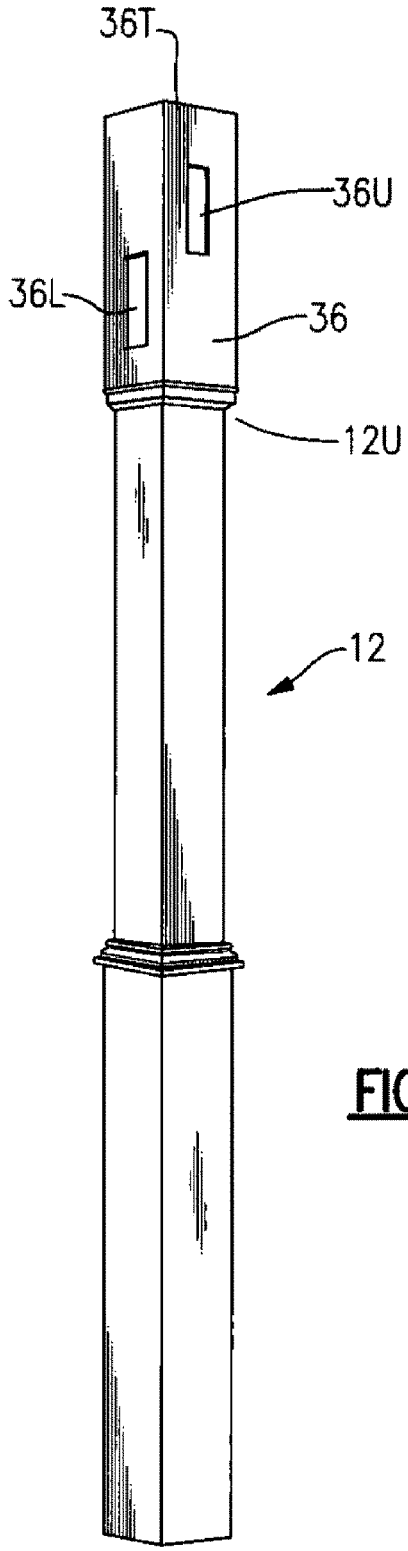
FIG. 3 is an isometric illustration of a post shell extension.

In further aspects of the present invention, as illustrated for example in FIG. 3, the upper ends 12U of corner posts 12C, the upper ends of the post core elements 24P and the carrying rail adapters 28 and rail connectors 30 mounting the carrying rails 16 and cross rails 18 to corner posts 12C may be enclosed in shell extensions 36 to provide a finished appearance similar to that of classical pergola structures. In the example illustrated in FIG. 3, the shell extension 36 is a hollow, box-like structure comprised of four vertical walls, open at the top and bottom, with a generally square or rectangular cross section, a height greater than its horizontal dimensions and a height sufficient to extend from the top of the post shell 24S and upper post adapter 26 to a point above the top of cross rails 18, which are typically vertically above the carrying rails. A shell extension 36 further includes an upper pair of corresponding diametrically opposed rail openings 36U and a lower pair of corresponding diametrically opposed rail openings 36L through which a cross rail 18 and an end carrying rail 16E may extend.

As illustrated, the pairs of openings 36U and 36L are oriented at a right angle to each other and it will be appreciated that openings 36U and 36L may be open at their upper and lower sides, respectively, thereby forming U-shaped upwardly facing and downwardly facing openings and allowing a shell extension 36 to be placed over the corner junction between the carrying rail adapter 28 and rail connector 30 after assembly of the carrying rail adapter 28, rail connector 30 and carrying rail 16 and before the subsequent assembly of the cross rail 18 into the rail connector 30. In other embodiment, the upper and lower sides of openings 36U and 36L may be closed, so that the carrying rail 16 and cross rail 18 must be inserted longitudinally into the openings 36U and 36L during assembly of the corner structure, but proving a more completely enclosed structure.

Finally in this regard, the open upper side 36T of a shell extension 36 will typically be closed by a decoratively shaped shell cap 36C, thereby protecting the corner element assembly from the environment and completing the visual appearance of the corner element assembly of the pergola structure 10.

Figure 4:
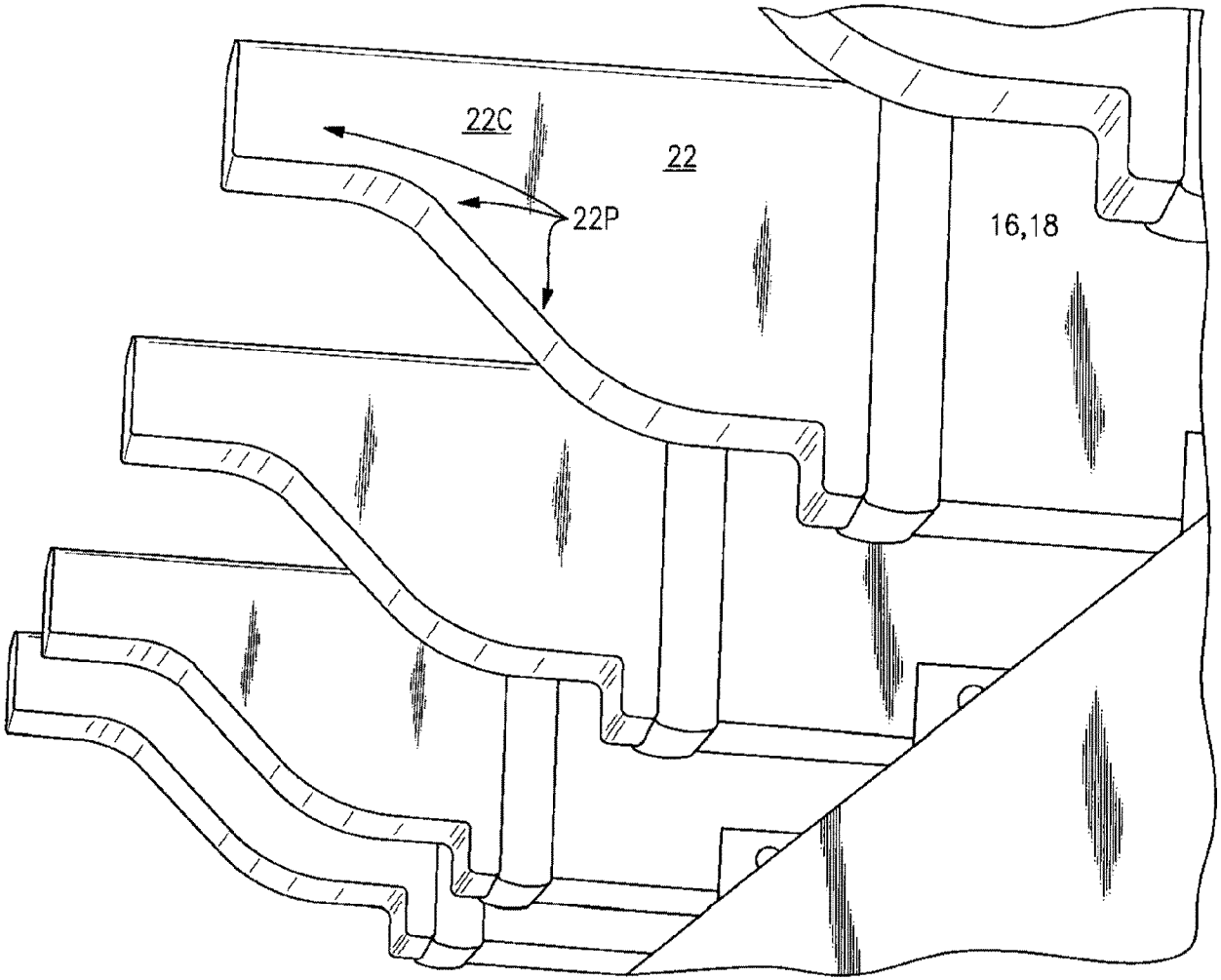
FIG. 4 is an isometric illustration of a rail cap.

It should also be noted that in the classical pergola structure 10 the ends 22 of the carrying and cross rails 16, 18 are decoratively shaped according to a decorative profile 22P and, as in the case of shell extensions 36, the ends of rails 16, 18 may be formed into a decorative profile 22P by, for example, shaping of the ends of the rails 16, 18 or by covering the ends of the rails with caps 22C having the desired profile 22P, as illustrated in FIG. 4. It will also be noted that the uprights 12 may be square or rounded and may include decorative shaping and that the upper ends 12U of the uprights 12, which classically extend above the level of the cross rails 18 are also shaped decoratively and to shed water.

Considering further aspects of carrying rails 16 and cross rails 18, it has been described above that end and intermediate carrying rails 16E and 16I and cross rails 18 may be comprised, for example, of wood, extruded aluminum or plastic or polyvinyl chloride (PVC), or fiberglass or similar man-made materials and, in the case of extruded rails 16 or 18, will thereby typically be hollow, often with an internal reinforcing structure.

It may be desirable or necessary in certain instances, however, such as pergola structures 10 having extended spans or inter-rail spacing or situated in areas having greater than average snow, ice or wind loads, that carrying rails 16 or cross rails 18 have greater strength or load bearing capability than can be provided by hollow rails 16, 18 made, for example, of aluminum, plastic, polyvinyl chloride (PVC), fiberglass or other man-made materials. According to the present invention, such enhanced strength and load bearing capability may be provided by "A" beam filled rails 38, as illustrated in FIG. 5, each of which is comprised of a rail shell 38S and an beam insert 38I comprised, for example, of extruded aluminum or folded and welded aluminum sheet material.

Figure 5:
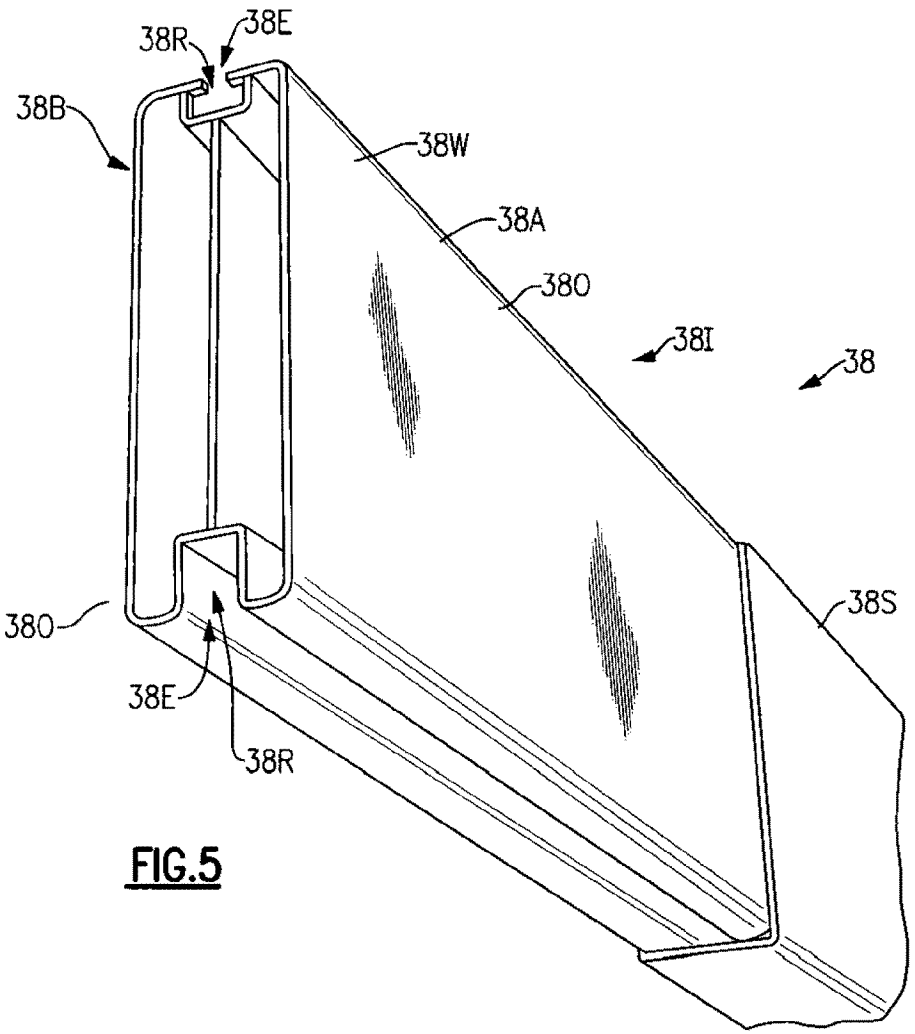
FIG. 5 is an isometric illustrations of a beam filled rail.

In an exemplary embodiment of an A beam filled rail 38 as shown in FIG. 5, for example, rail shell 38S is comprised of aluminum, plastic, polyvinyl chloride (PVC), fiberglass or other man-made materials with outside dimensions corresponding to those desired for a carrying rail 16 or cross rail 18 and a wall thickness depending upon the material comprising the rail shell 38S. In, for example, the case of a shell 38S comprised of PVC or fiberglass, the wall thickness may for example be in the range of 0.90 inch to 0.120 inch. A beam insert 38I, in turn, has a generally rectangular cross section of dimensions to fit closely within the rail shell 38S and includes two vertically oriented, hollow generally rectangular sections 38A and 38B, each of which is defined by a vertical outer wall 38O extending the height of the beam insert 38I and two horizontal end walls 38E extending from the upper and lower edges of the corresponding outer wall 38O for approximately half the width of the beam insert 38I. The beam insert sections 38A and 38B are joined across their vertical extent by a common, shared vertically oriented web 38W connecting the inner edges of the upper and lower end walls 38E to form a structural reinforcement of the rail insert 38 in the manner of the web of an I-beam. As also shown in FIG. 3, the upper and lower sides of a rail insert 38 may include U-shaped recesses 38R formed in beam insert end walls 38E, with corresponding adaptation of the vertical length or height of beam insert web 38W, thereby providing a further structural reinforcement of the beam 38I.

Next considering alternate embodiments and implementations of certain structural aspects of the present invention as described above, FIGS. 6 and 7 are diagrammatic illustrations of alternate embodiments and implementations of a post 12 assembly, a post shell adapter 26, carrying rails 16 and cross rails 18, a carrying rail adapter 28 and rail connectors 30.

Figure 6:
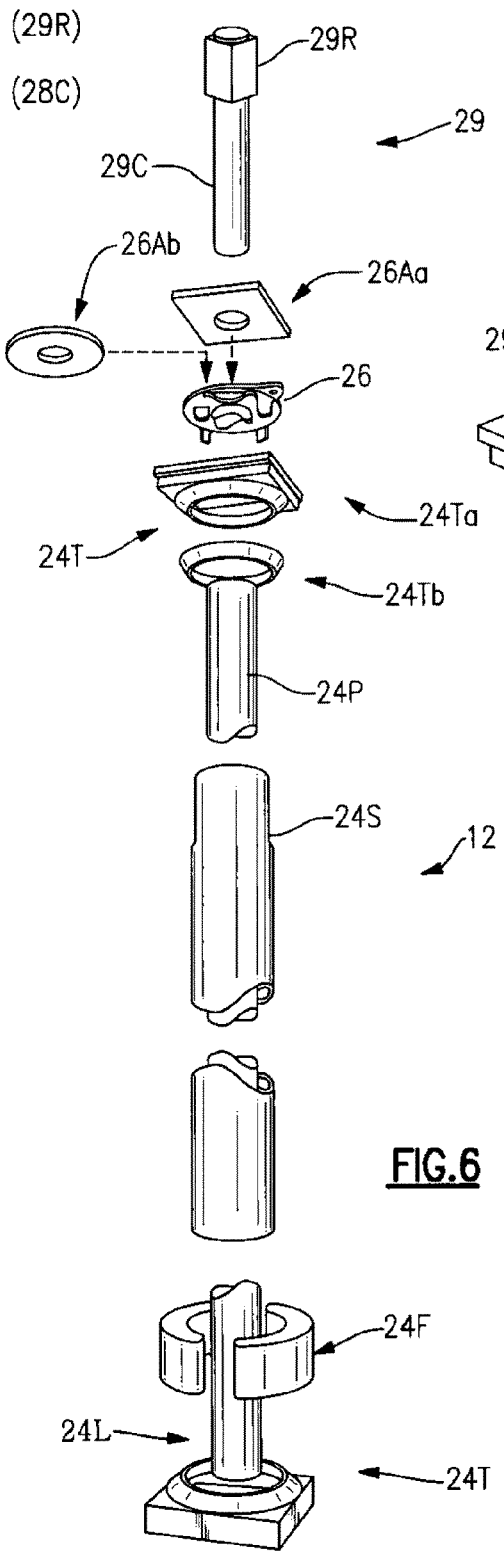
FIGS. 6, 7 and 8 are illustrations of alternate embodiments of a post assembly and carrying rail adapter; and, FIGS. 9A, 9B and 9C are exemplary alternate embodiments of cross rail adapters.

As illustrated in FIG. 6, the exemplary post assembly 12 shown therein again includes a post core element 24P encased in a post shell 24S which is secured to and supported by the post core element 24P by post adapters 26. As described, a post adapter 26 includes post core exterior adapter 26C having an interior shape and dimensions closely accepting and fitting to the exterior shape and dimensions of the post core element 24P and a post shell adapter 26S having an outer shape and dimensions fitting closely within the post shell 24S. In the embodiment illustrated in FIGS. 6 and 7, however, the dimensions and shape of the post shell 24S may differ significantly from the exterior shape and dimensions of post shell adapter 26S. In addition, the upper or lower or both ends of a post assembly 12 may include and be terminated by one or more shell trim elements 24T which terminate the upper and/or lower ends of the post assembly 12 and which are, like the illustrated post shell 24S, of greater dimension and a different shape than post shell adapter 26S of a post adapter 26.

Figure 7:
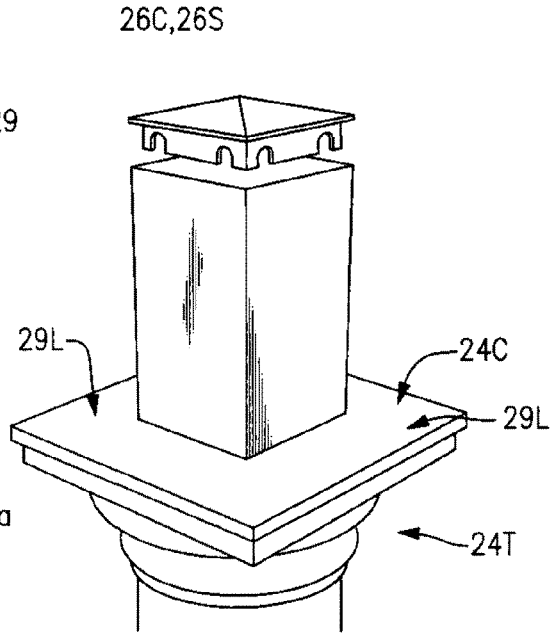

In such instances, either or both of the upper and lower post adapters 26 may be adapted to accommodate a large dimensioned or differently shaped post shell 24S or shell trim elements 24T by the use of shell adapter plates 26A. As illustrated in FIG. 6, which illustrates both a square shell adapter plate 26Aa and a round shell adapter plate 26Ab, shell adapter plates 26A are generally flat plates having a central opening sized and shaped to closely accept and fit onto the exterior shape and dimensions of post core exterior adapter 26C of the post adapter 26 and an outer shape and dimensions to closely fit within and accept the interior shape and dimensions of, for example, the post shell 24S or a shell trim element 24T. The shell trim element 24T may be presented in a unitary piece, or may be presented as two pieces, as a first larger portion 24Ta and a second smaller portion 24Tb, to be joined together onsite. It will therefore be apparent that, like a post adapter 26, a shell adapter plate 26A secures and supports a post shell 24S or shell trim element 24T to the post core element 24P. Lastly, a shell adapter plate 26A may be secured to a post adapter 26 by any of the methods previously described herein, such as screws, bolts, adhesives, welding and so on. In addition, and as shown in FIG. 7, the upper side of the post shell 24S or shell trim element 24T will typically be closed and sealed by a trim cover plate 24C shaped to fit around the post core exterior adapter 26C and within the post shell 24S or shell trim element 24T and generally comprised of the same material as the post shell 24S or shell trim element 24T. Additionally, the post shell 24S may be further secured by including a post shell spacer 24F between the post shell 24S and the post core element 24P.

Referring again to FIGS. 6 and 7, therein are also illustrated an alternate embodiment and implementation of a carrying rail adapter 28 with corresponding alternate embodiments and implementations of rail connectors 30 and arrangements of carrying rails 16 and cross rails 18.

In the embodiment of carrying rail adapters 28, rail connectors 30, carrying rails 16 and cross rails 18 previously described in association with in FIGS. 1, 2B, 2C, 2D and 2E, a carrying rail adapter 28 sits atop a post core element 24P and engages and supports a single carrying rail 16 so that the carrying rail 16 passes through the top of the post assembly 12, with one or more cross rails 18 being secured transversely atop each carrying rail 16 by rail connectors 30.

In the alternate embodiment illustrated in FIGS. 6 and 7, the single rail carrying rail adapter 28 is replaced with a dual carrying rail adapter 29 which, like a single carrying rail adapter 28 includes a modified post core interior adapter 29C that is shaped and dimensioned to fit closely within the interior of upper end 24U of post core element 24P and is of such a length as to provide a secure junction between the modified post core interior adapter 29C and the post core element 24P. Unlike a single rail carrying rail adapter 28, however, which includes a carrying rail retainer 28R to accept and secure a single carrying rail 16, a dual carrying rail adapter 29 includes a dual carrying rail retainer 29R having a generally square or rectangular horizontal cross section and extending upwards from the top of the modified post core interior adapter 29C by a distance approximately equal to the height of carrying rails 16. The horizontal dimensions of dual carrying rail retainer 29R are less than the horizontal dimensions of the shell adapter plate 26A or shell trim element 24T, thereby forming rail ledges 29L to receive and support a carrying rail 16 on each side of the dual carrying rail retainer 29R. Lastly, the top end of dual carrying rail retainer 29R may be open, or closed to provide a stronger, better sealed structure, and will typically be subsequently capped by a shell cap 36C or similar trim element.

Figure 8:
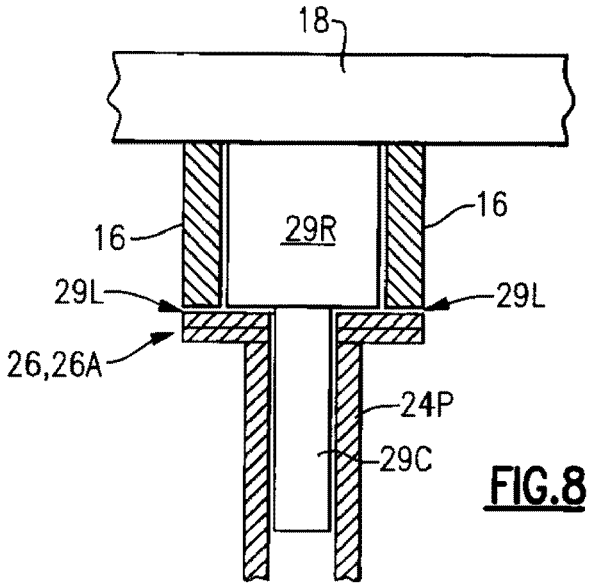

As shown in FIG. 8, a carrying rail 16 is mounted on each side of the dual carrying rail retainer 29R of a dual carrying rail adapter 29, with the carrying rails 16 resting on and supported by rail ledges 29L and secured to the dual carrying rail retainer 29R by any of the methods described previously herein, such as bolts, screws, nails, adhesives, and so on. The resulting structure accordingly is comprised of two parallel carrying rails 16 passing to either side of the post assembly 12, rather than a single carrying rail 16 penetrating through the top of the post assembly 12.

Figures 9A, 9B, 9C:
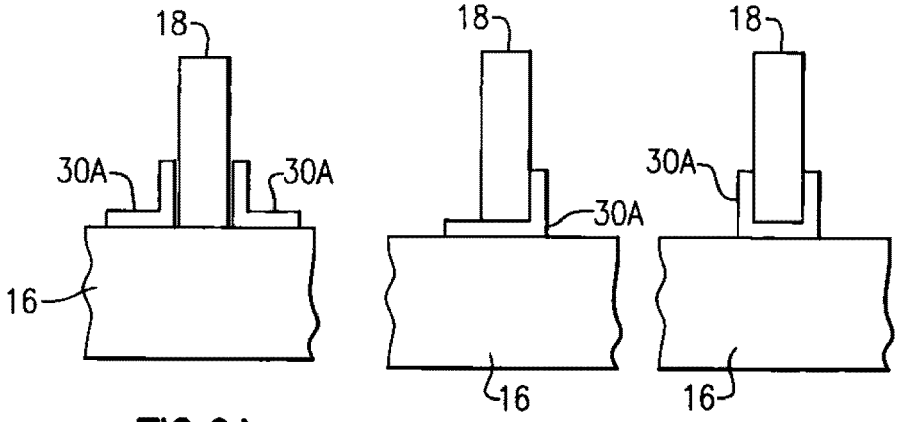

Next referring to alternate methods of mounting of cross rails 18 to carrying rails 16, and in particular to dual parallel carrying rails 16, cross rails 18 may again be mounted to a carrying rail 16 by rail connectors 30, as described previously with reference to FIGS. 2D and 2E, but with each cross rail 18 being individually mounted to each of the carrying rails 16 of a parallel pair of carrying rails 16 by a rail connector 30 and with the dimensions of the rail connectors 30 adapted to the spacing between the carrying rails 16 if necessary. In an alternate embodiment and implementation, however, examples of which are illustrated in FIGS. 9A, 9B and 9C, each cross rail 18 may be secured to each carrying rail 16 of each pair of parallel carrying rails 16 by one or more cross rail brackets 30A. As illustrated in FIGS. 9A, 9B and 9C a cross rail bracket 30A may be comprised of an L or U shaped angle bracket with one arm of the bracket secured to the carrying rail 16 and the other arm of base secured to the cross rail 18 by, for example, nails, screws, bolts or other fastening elements, as previously described herein above.

It will be apparent that certain changes may be made in the above described improved feed mechanism for feeding a boring bar, without departing from the spirit and scope of the invention herein involved, it is therefore aluminum, plastic, polyvinyl chloride (PVC), fiberglass or other man-made materials intended that all of the subject matter of the above description or shown in the accompanying drawings shall be interpreted merely as examples illustrating the inventive concept herein and shall not be construed as limiting the invention.

What is claimed is:

1. A system, including a plurality of types of modular structural components, for construction of a pergola-type structure including a plurality of vertical posts arranged around the periphery of an area and covered by a roof formed of a rectangular grid or lattice comprised of a first layer formed of a plurality of carrying rails supported by the posts and an upper layer formed of a plurality cross rails supported by and orthogonal to the carrying rails, the structural elements comprising:

at least four posts, each post including a post core element, a post shell enclosing the post core element, and at least one post shell adapter for mounting the post shell to the post core element, a plurality of carrying rail adapters, each carrying rail adapter mounting at least one carrying rail to a post and including a post core interior adapter and a carrying rail retainer, the post core interior adapter being adapted to fit closely within an interior of an upper end of a post core element and the carrying rail retainer including elements for securing at least one carrying rail to the carrying rail adapter, and a plurality of rail connectors, each rail connector mounting a cross rail to a carrying rail.

2. The system according to claim 1, wherein:

the carrying rail retainer of the carrying rail adapter includes two upwardly extending carrying rail retaining plates spaced apart along an axis perpendicular to an axis of a carrying rail by a distance to closely receive a carrying rail, and each rail connector includes a downwardly extending U-shaped carrying rail connector and an upwardly extending U-shaped cross rail connector with an axis of the carrying rail connector and an axis of the cross rail connector being oriented at a right angle so that the cross rail is mounted to a rail connector at a right angle to the carrying rail.

3. The system according to claim 1, wherein:

the carrying rail retainer of the carrying rail adapter comprises a dual carrying rail retainer having one of a square and a rectangular horizontal cross section and extending upwards from a top of the core adapter by a distance generally corresponding to a height of a carrying rails horizontal dimensions forming rail ledges to receive and support a carrying rail on each side of the dual carrying rail retainer.

4. The system according to claim 3, wherein:

each rail connector comprises one of a downwardly extending U-shaped carrying rail connector and an upwardly extending U-shaped cross rail connector with an axis of the carrying rail connector and an axis of the cross rail connector being oriented at a right angle so that the cross rail is mounted to a rail connector at a right angle to the carrying rail, an L-shaped angle bracket affixed between a carrying rail and a cross rail, and a U-shaped angle bracket affixed between a carrying rail and a cross rail.

5. The system to claim 1, wherein:

a post adapter includes a post core exterior adapter joined with a shell adapter wherein an interior shape and dimensions of the post core exterior adapter closely accept an exterior shape and dimensions of the post core element and an outer shape and dimensions of the shell adapter fit closely within the shell and a post adapter securing element to mount the post adapter to the post core element.

6. The system according to claim 5, wherein the post adapter further includes a shell adapter plate comprised of a generally flat plates having a central opening sized and shaped to closely accept and fit onto the exterior shape and dimensions of the post core exterior adapter and an outer shape and dimensions to closely fit within and accept an interior shape and dimensions of one of a post shell and a shell trim element.

7. The system according to claim 1, further including:

a shell extension for enclosing a rail adapter and a rail connector of a corner post, the shell extension including a hollow structure of four vertical walls, open at an upper end and a lower end, and of a height and width to enclose the rail adapter and rail connector and having upper and lower pairs of rail openings for respectively receiving a cross rail and a carrying rail, the upper pair of rail opening being oriented at a right angle to the lower pair of rail openings.

8. The system according to claim 1, wherein:

a carrying rail adapter further includes a post core interior adapter securing element for mounting the post core interior adapter into the post core element and a carrying rail securing element for mounting a carrying rail to the carrying rail retainer.

9. The system according to claim 1, wherein:

each carrying rail and each cross rail is oriented with a width of the carrying rail and the cross rail extending vertically.

10. The system according to claim 1, wherein:

a rail connector further includes a carrying rail securing element for mounting the rail connector to a carrying rail and a cross rail securing element for mounting a cross rail to the rail connector.

11. The system according to claim 1, wherein at least one rail is a beam filled rail comprising:

a rail shell and an beam insert.

12. The system according to claim 11, wherein:

the rail shell has a generally rectangular cross section with outside dimensions corresponding to one of a carrying rail and a cross rail and inside dimensions for closely accepting the beam insert, and the beam insert has a generally rectangular cross section of dimensions to fit closely within the rail shell and includes two vertically oriented, hollow generally rectangular sections, each of which is defined by a vertical outer wall extending a height of the beam insert and two horizontal end walls extending from an upper edge and a lower edge of the corresponding outer wall for approximately half a width of the beam insert and wherein the beam insert sections are joined across a vertical extent of the beam insert sections by a shared vertically oriented web connecting the inner edges of the upper and lower end walls.

13. The system according to claim 12, wherein:

an upper side and a lower side of the rail insert include U-shaped recesses formed in the beam insert end walls with the beam insert web extending between the U-shaped recesses.

14. The system according to claim 3, further including a shell cap for enclosing an upper end of a shell extension.

15. The system according to claim 1, further including a rail cap having a decorative profile for enclosing an end of a rail.

* * * * *